US005313870A

United States Patent [19]

Clark

[11] Patent Number: 5,313,870

[45] Date of Patent: May 24, 1994

[54] DOUBLE PISTON PROPULSION UNIT

[75] Inventor: Robert O. Clark, Tonbridge, United Kingdom

[73] Assignee: The Secretary of State for Defence in Her Britannic Majesty's Government of the United Kingdom of Great Britain and Northern Ireland, Hants, England

[21] Appl. No.: 39,143

[22] PCT Filed: Sep. 27, 1991

[86] PCT No.: PCT/GB91/01661

§ 371 Date: Apr. 23, 1993

§ 102(e) Date: Apr. 23, 1993

[87] PCT Pub. No.: WO92/06344

PCT Pub. Date: Apr. 16, 1992

[30] Foreign Application Priority Data

Sep. 27, 1990 [GB] United Kingdom ..... 9021060

[51] Int. Cl.[5] ..... F41A 1/10

[52] U.S. Cl. ..... 89/1.701

[58] Field of Search ..... 89/1.701, 1.702, 1.703, 89/1.704, 1.705, 1.706

[56] References Cited

U.S. PATENT DOCUMENTS

| | | | |
|---|---|---|---|
| 3,128,670 | 4/1964 | Blacker | 89/1.702 |
| 3,800,656 | 4/1974 | Schnäbele | 89/1.701 |
| 4,643,071 | 2/1987 | Baechler et al. | 89/1.701 |
| 4,676,136 | 6/1987 | Kälin | 89/1.701 |

FOREIGN PATENT DOCUMENTS

| | | |
|---|---|---|
| 0256894 | 2/1988 | European Pat. Off. . |
| 3002285 | 2/1981 | Fed. Rep. of Germany . |
| 2619616 | 2/1989 | France . |
| 335118 | 2/1959 | Switzerland . |
| 2183800 | 6/1987 | United Kingdom . |

*Primary Examiner*—David H. Brown
*Attorney, Agent, or Firm*—Nixon & Vanderhye

[57] ABSTRACT

A double piston propulsion unit for a recoilless mass/-countermass projectile launcher comprises two hollow cylindrical pistons (22, 23) arranged in a back-to-back relationship with closed outer ends and open inner ends, the open inner ends being joined together by a circumferential rupturable connecting means so that the pistons form a vessel in which a propellant charge (34) is enclosed. In operation, the unit is slideably located inside the open-ende launch tube (1) of the projectile launcher at its mid-point. The propellant when initiated causes a build up of propellant gases inside the vessel and when the gas pressure reaches a pre-determined value the connecting means fails in tension and the piston (22, 23) are propelled in opposite directions. The tensile and compressive force experienced by the pistons (22, 23) during the firing of the unit are substantially decreased compared to known units, so that relatively lightweight pistons (22, 23) can be employed.

10 Claims, 5 Drawing Sheets

DOUBLE PISTON PROPULSION UNIT

BACKGROUND OF THE INVENTION

1. Field of the Invention;

The invention relates to a double piston propulsion unit for a recoilless mass/countermass projectile launcher and in particular for a hand-held shoulder-launched system suitable for launching a projectile from a confined space.

DISCUSSION OF PRIOR ART

Recoilless mass/countermass launchers operate by simultaneously firing a projectile forwardly and a countermass rearwardly with equal and opposite momentum. This prevents any recoil from being transmitted to the launcher, so that the launcher requires no recoil support and can be hand-held provided that the weight of the launcher can be supported by a human operator.

Propulsion units for recoilless mass/countermass projectile launchers are known in which an open ended launch tube has two cylindrical pistons of equal mass located in a back-to-back relationship within it which are releasably restrained either side of a propellant charge (see FIG. 1). One piston is for propelling the projectile out of the open forward end of the tube and the other is for propelling the countermass out of the open rearward end of the tube. The two pistons are releasably restrained by an axially-located connecting rod secured therebetween in which an area of weakness is provided. The propellant charge is located in the space surrounding the rod between the two pistons.

These known propulsion units are oprated by the activation of triggering means which initiates the propellant charge, the combustion of which causes a build up of hot gases in the space between the pistons. When the pressure of the gas reaches a predetermined level the weakness provided in the connecting rod causes the rod to fail in tension and the pistons are projected along the launch tube in opposite directions, thus projecting the projectile forwards and the countermass rearwards. The launch tube has piston intercepts at both its ends which halt the pistons but allow the projectile and countermass to leave the tube.

Such units with the pistons connected by an axially-located connecting rod carry a substantial mass penalty. This is because the pistons need to be axially thickened to withstand the tensile and compressive forces transmitted to them by the rod during the launching of a projectile. A high mass propulsion unit is clearly a disadvantage especially for a launcher designed to be hand-held and shoulder launched.

SUMMARY OF THE INVENTION

The present invention provides a propulsion unit for a recoilless mass/countermass projectile launcher which enables a significant mass reduction to be made. Furthermore the present invention enables a significant length reduction to be made in the unit which increases the effective stroke of the pistons for any given launch system length and provides a potentially safer and more cheaply and easily manufactured propulsion unit.

According to a first aspect of the present invention there is provided a double piston propulsion unit for a recoilless mass/countermass projectile launch system comprising two pistons of substantially equal mass arranged in a back-to-back relationship and a propellant charge disposed between the two pistons, wherein the pistons comprise hollow cylinders with closed outer ends and open inner ends, said open inner ends being joined together by a circumferentially rupturable connecting means so that the hollow cylinders together form a vessel enclosing said propellant charge.

The two hollow cylindrical pistons are joined together at their open ends so removing the need for an axially-located connecting rod and bolts between the pistons. Therefore the pistons no longer have to withstand the large tensile and compressive forces associated with attachment to the connecting rod, so enabling the thickness and thus the mass of the pistons to be reduced substantially. The reduced mass of the pistons also enables the mass of propellant used to launch the projectile at a required velocity to be reduced. The combined effect of the reduced mass of the pistons and propellant charge means that the propulsion unit provided by the present invention is substantially less massive than those known in the art, which is a particular advantage for a hand- held shoulder-launched systems.

Another advantageous feature of the present invention is that the length of the propulsion unit can be substantially reduced, compared to known units, while still providing the same cavity volume inside the vessel per unit mass of propellant. This is enabled because the pistons are much thinner than those known in the art and because the connecting rod is not needed, so that a larger proportion of the unit forms the cavity between the pistons.

This can be advantageous in one of two ways. Either the length of the launch tube that is available for the acceleration of the pistons is substantially increased, therefore a reduced amount of propellant can be used to launch the projectile at the required velocity, which can lead to a further mass reduction of the propulsion unit, or the decrease in length of the propulsion unit can enable the length of the launch tube to be reduced by a like amount, which can lead to a reduction in mass of the launch tube.

In a preferred embodiment of the present invention the circumferential rupturable connecting means comprises a seal so that the hollow cylinders together form a closed pressure vessel. The advantage of this arrangement is that the propellant is totally encapsulated within the pressure vessel formed by two joined pistons. Therefore once the propulsion unit has been assembled it can be safely stored, handled and loaded into an extracted from the launch tube at any subsequent time.

In a preferred embodiment of the present invention the circumferential rupturable connecting means comprises a lap joint with the lapped section of the joint located on the internal surface of the pressure vessel. The advantage of such a joint is that it provides a large interface between the piston halves at which a screw thread or cement can be located to secure the pistons together while the outer surface of the pressure vessel remains a right cylinder so that it can be slideably located within the launch tube.

In an especially preferred embodiment of the present invention the said lap joint is secured by a cement adapted to fail when subjected to a predetermined shear force. The advantage of this arrangement is that the cemented joint can be constructed so that it fails when the propellant gas pressure inside the pressure vessel reaches a predetermined value. The joint failure pressure being one of the controllable factors which can determine the launch velocity of the projectile. Furthermore this embodiment is cheaply and easily manufactured.

In another preferred embodiment of the present invention the circumferential rupturable connecting means comprises a connecting collar which is located within the hollow cylinders and is secured by a screw thread or cement over the circumferential region of contact between the said open ends of the cylinders. The advantages of this joint are similar to those of the lap joint in that a large interface is provided between the collar and each of the cylinders at which a screw thread or cement is located while the outer surface of the pressure vessel remains cylindrical.

The said holow cylindrical collar is preferably made of a weaker material than that of the pressure vessel and has a circumferential rupturable weakness in the form of an annular groove in its inner or outer circumferential surface adjacent to the circumferential region of contact between said open ends of the cylinders. This arrangement is advantageous in the case when the pressure vessel is made of such a strong material that is is not possible to provide a weakness in it in the form of an annular groove in its surface. The connecting collar can be designed to fail in tension when subjected to a predetermined tensile force by carefully choosing the tensile strength of the material from which it is made and the depth of the annular groove.

In a further preferred embodiment of the present invention said circumferential rupturable connecting means comprises an annular region of the vessel having a multiplicity of perforations therein. This arrangement provides a further method of providing a circumferentially rupturable weakness in the pressure vessel when it is made of a very strong material. The tensile force at which the strips between the perforations fail is determined by the ratio of the length of the perforations to the length of the strips.

Preferably the propellant charge is supported within the hollow cylinders by a support means extending radially inwards from the walls of the vessel. Such a support means is advantageous because it supports the propellant charge without hindering its combustion.

In a further embodiment of the present invention each of the said closed ends of the cylinders comprises a central convex dome surrounded by a plane rim. This convex dome is advantageous because it ensures that the cavity inside the pressure vessel is as spherical as possible, the plane rim being provided to form a good contact with the piston intercepts during the braking of the piston.

The present invention further provides a recoilless mass/countermass projectile launcher which enables a substantial mass reduction over known launchers, as well as providing the advantages associated with the propulsion unit mentioned above.

According to a further aspect of the present invention there is provided a recoilless mass/coountermass projectile launcher, comprising:

a launch tube open at its forward and rearward ends;

a double piston propulsion unit according to the first aspect of the present invention, the propulsion unit being slideably located inside the launch tube at its mid-point;

piston intercepts located at said forward and rearward ends of the launch tube, and a triggering means for activating the propulsion unit.

Advantageous mass reductions are enabled in a launcher according to the present invention further to the mass reduction in the propulsion unit that is mentioned above. This is because the pistons are less massive so (a) the kinetic energy to be absorbed by the piston intercepts is reduced and so the mass of the piston intercepts can be reduced and (b) the axial load transferred onto the launch tube from the piston intercepts during the braking of the pistons is reduced and so the strength and thus the mass of the launch tube can be reduced.

Furthermore because the less massive pistons are easier to brake they are less likely to escape from the end of the launch tube due to failure of the piston intercepts. This is a useful safety feature of the present invention that reduces the likihood of an outrush of hot gases from the ends of the tube.

Another advantage is that the holow cylindrical sections of the pistons form piston skirts which provide an effective gas seal with the launch tube. Therefore when the projectile and countermass have been launched from the tube halted pistons seal its open ends, thus preventing a dangeous outrush of combustion gases therefrom.

BRIEF DESCRIPTION OF THE DRAWING

A propulsion unit for a recoilless mass/countermass projectile launcher and a launcher incorporating the same will now be described in more detail by way of example only with reference to the accompanying drawings, in which.

DETAILED DISCUSSION OF PREFERRED EMBODIMENTS

Figure 1:
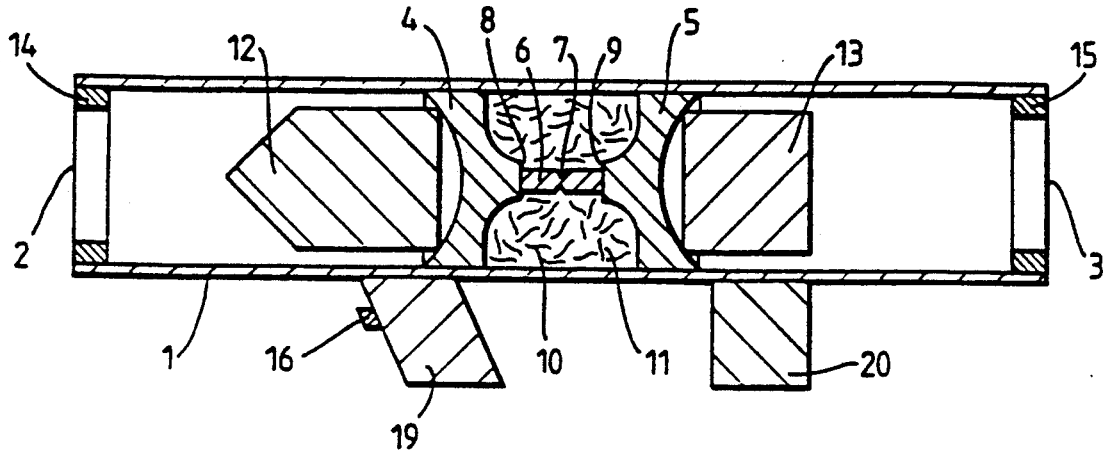
Fig. 1. (PRIOR ART)
FIG. 1 is a schematic diagram of a vertical longitudinal section through a known type of recoilless mass/countermass launcher loaded with a projectile and a countermass.

Referring to FIG. 1 a recoilless mass/countermass projectile launcher of known design comprises a launch tube 1 which is open at its forward end 2 and rearward end 3. Two pistons 4 and 5 are slideably located within the launch tube 1, arranged back-to-back with piston 4 facing the forward end 2 piston 5 facing the rearward end 3. The two pistons 4 and 5 are releasably joined together by an axially-located connecting rod 6 in which a weakness in the form of machined circumferential groove 7 is provided. The connecting rod 6 is attached to the pistons 4 and 5 by screw threaded joints 8 and 9 respectively. The propellant 10 is located around the connecting rod 6 in the space 11 created between the pistons. A sub-calibre projectile 12 rests on the forward surface a piston 4 and a sub-calibre countermass 13 rests on the rearward surface of piston 5. Piston arrestors 14 and 15 are located at the forward end 2 and the rearwead end 3 of the launch tube respectively. The launch tube 1 has forward and rearward holding members 19 and 20 respectively, designed to make the launcher suitable for launching from the shoulder of a human operator. A trigger 16 is located on the forward holding member 19.

The known projectile launcher shown in FIG. 1 operates as follows. The trigger 16 is pressed causing a triggering mechanism (not shown) to initiate propellant 10. The hot propellant gases generated from the ignited propellent produce a build-up of pressure in the space 11 between the pistons 4 and 5. When the propellant gas pressure reaches a predetermined value the connecting rod 6 yields in tension at the weakness 7 causing the piston 4 and projectile 12 to be projected along the launch tube 1 towards the forward end 2 and the piston 5 and countermass 13 to be projected along the launch tube 1 towards the rearward end 3. The piston arrestor 14 stops the piston 4 and allows the prjectile 12 to leave the forward end 2 unhindered. Simultaneously the piston arrestor 15 stops the piston 5 and allows the countermass 13 to leave the rearward end 3 unhindered. The hot propellant gases are safely contained in the launch tube 1 because the pistons 4 and 5 seal the open forward end 2 and open rearward end 3 respectively.

The known projectile launcher shown in FIG. 1 and others like it suffer from the disadvantages previously herein described.

Figure 2:
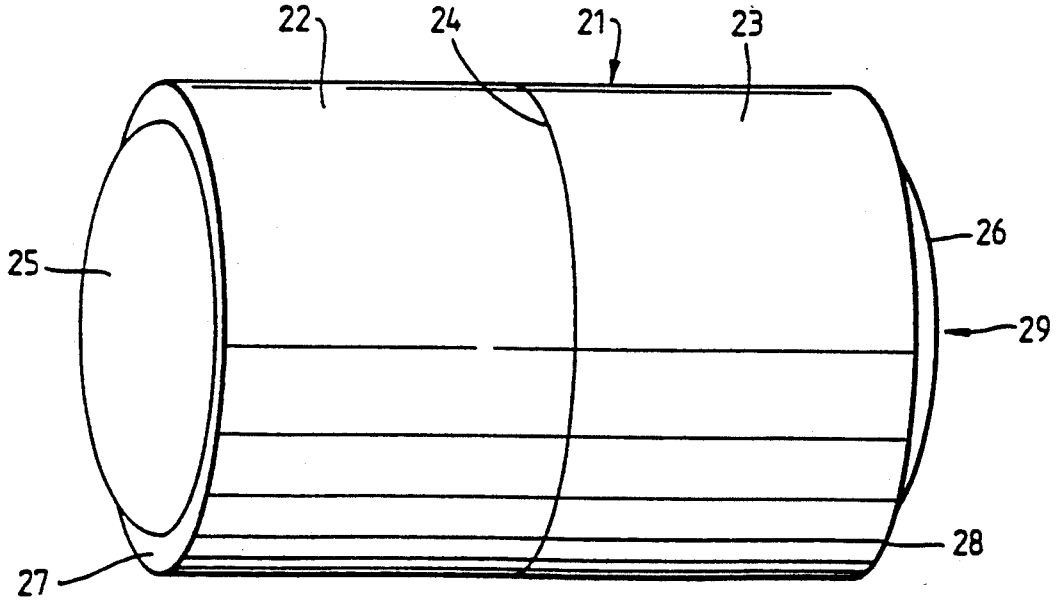
FIG. 2 is a perspective view of the propulsion unit constructed in accordance with the present invention.
Figure 3:
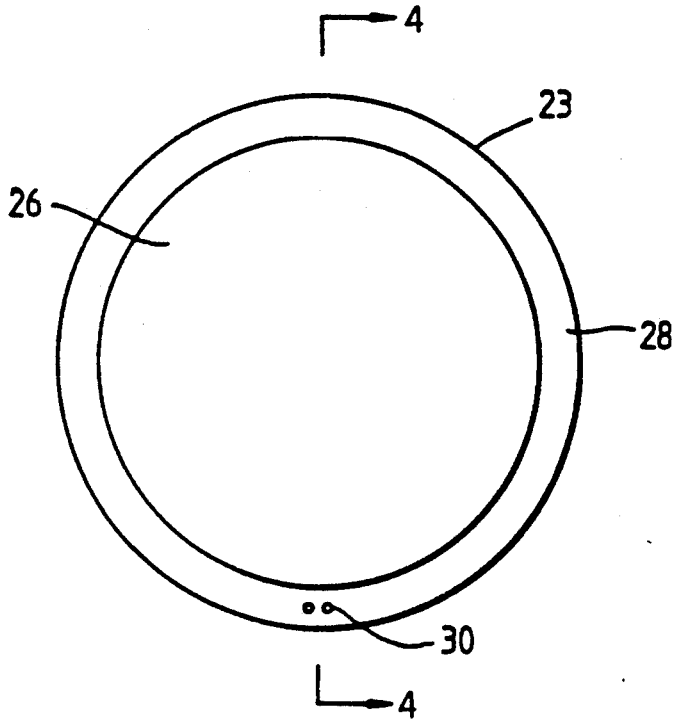
FIG. 3 is a view along the line 29 of FIG. 2.
Figure 4:
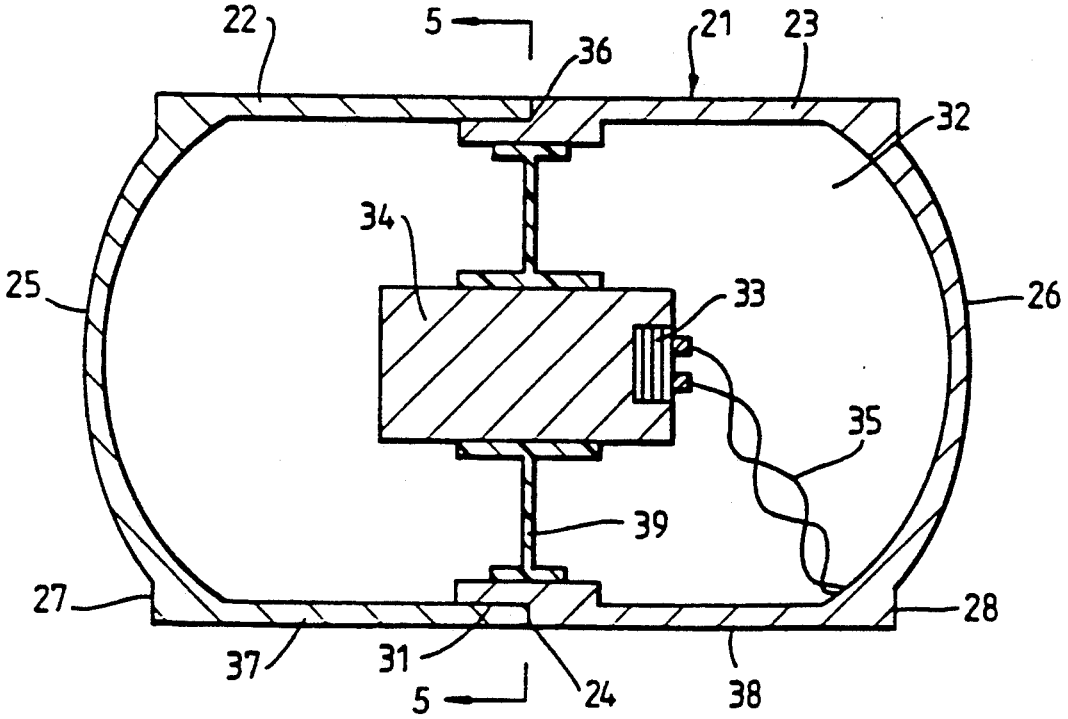
FIG. 4 is a vertical section taken along line 'AA' in FIG. 3.
Figure 5:
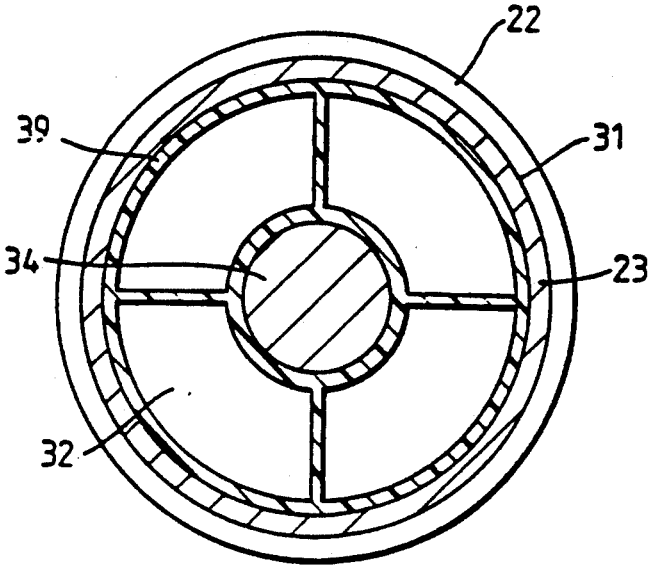
FIG. 5 is a vertical section taken along line 'BB' of FIG. 4.

One embodiment of the present invention will now be described with reference to FIGS. 2 and 5.

The double piston propulsion unit according to the present invention comprises a closed pressure vessel, denoted generally at 21. Two hollow cylindrical pistons of substantially equal mass 22 and 23 are joined at their open ends at 24 to form the closed pressure vessel 21.

The closed ends of the pistons 22 and 23 comprise central convex domes 25 and 26 and outer plane rims 27 and 28 respectively. The closed end of piston 23 has two holes 30 bored in its outer rim 28 through to the inner cavity of the pressure vessel 21 for the location of ignition wires 35.

The two pistons 22 and 23 are joined at their open ends by a cemented lap joint 36. The halves of the joint 36 are cemented together at the interface 31 by a cement chosen to have a shear strength which will cause the joint 36 to fail when it is subjected to a predetermined shear force well before tensile failure of either of the walls of the pistons can occur.

A propellant charge 34 is contained within a cavity 32 formed inside the pressure vessel 21 and is supported by a radial support web 39. The web 39 is constructed so as not to effect the combustion of the propellant charge 34 and can for example be made out of a plastic material. An igniter 33 located at the surface of the propellant charge 34 is connected to a triggering mechanism (not shown) by the two ignition wires 35 which pass through the holes 30.

The hollow cylindrical sections 37 and 38 of the pistons 22 and 23 respectively provide skirts for the pistons.

Figure 6A:
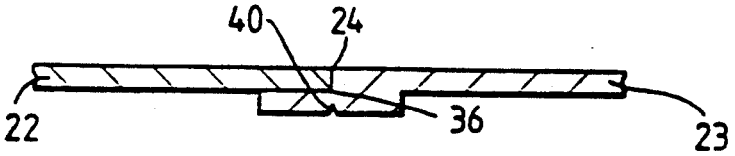
FIGS. 6A to 6D are sectional views of the joint between the two hollow cylindrical pistons showing alternative embodiments of the propulsion unit according to the present invention.
Figure 6B:
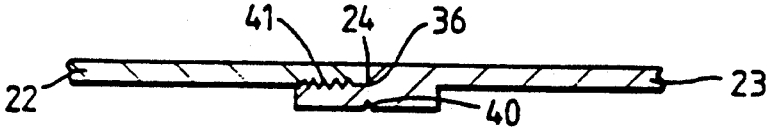
Figure 6C:
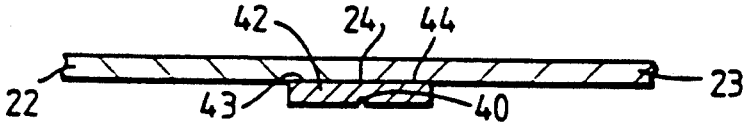
Figure 6D:
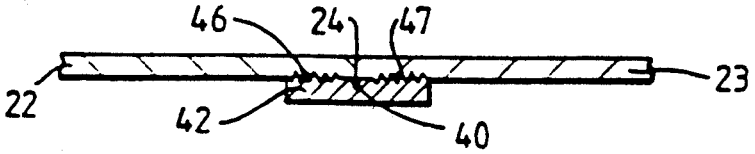

FIGS. 6A and 6D show alternative embodiments for the circumferentially rupturable connecting means between the open ends of the pistons 22 and 23.

FIG. 6A shows a cemented lap joint 36 in which the cement is strong enough to remain intact throughout the firing of the propulsion unit. An annular groove 40 is machined on the inner surface of piston 23 in the plane of the joint 24. The groove 40 is machined in such a way as to cause the piston 23 to fail along the groove when it is subjected to a predetermined tensile force thus releasing the pistons 22 and 23. Alternatively the annular groove 40 can be machined on the outer surface of piston 23.

FIG. 6B shows a similar joint to that in FIG. 6A except that instead of being cemented the lap joint is screw-threaded at 41 so that it is strong enough to remain intact throughout the firing of the propellant unit.

FIG. 6C shows a joint 24 which is held in place by a connecting collar 42 made of a weaker material than that which makes up the walls of the pressure vessel 21. The collar 42 is slideably located within the pistons 22 and 23, the mid-point of the collar lying in the plane of the joint 24. An annular groove 40 is machined on the inner surface of the collar 42 in the plane of the joint 24. The collar 42 is cemented to the pistons 22 and 23 along surfaces 43 and 44 respectively avoiding the area around the joint 24, the cement being strong enough to remain intact throughout the firing of the propulsion unit. The groove 40 is designed so that the collar 42 fails along the groove 40 when it is subjected to a predetermined tensional force, thus releasing the pistons 22 and 23.

FIG. 6D shows a joint 24 which is similar to that in FIG. 6C except that the collar 42 is attached to the pistons 22 and 23 by screw threads 46 and 47 instead of cement and the annular groove 40 is machined on the outer surface of the collar instead of the inner surface.

Figure 7:
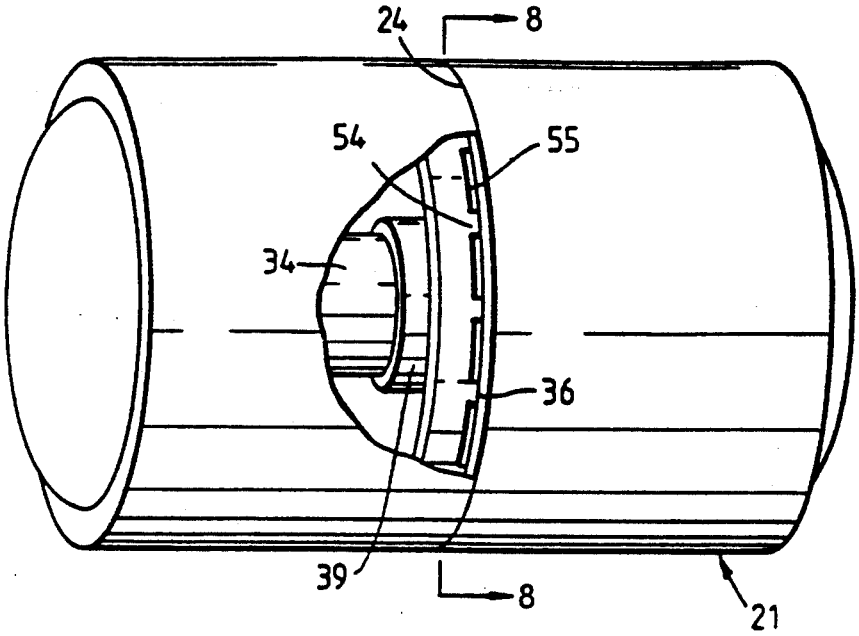
FIG. 7 is a perspective view of one preferred embodiment of the propulsion unit according the present invention with a section cut away.
Figure 8:
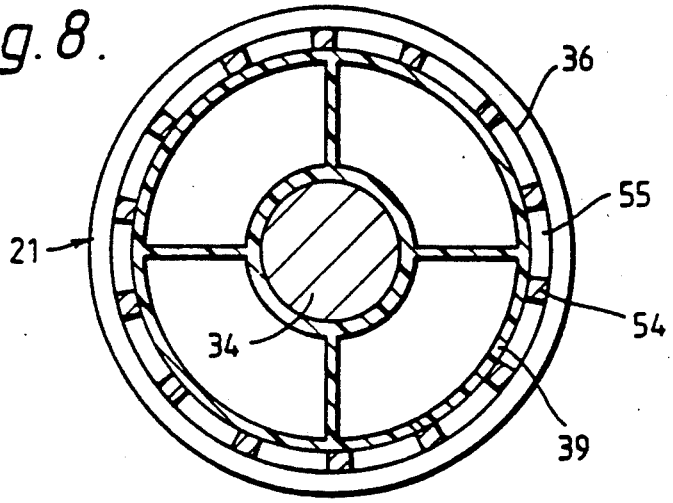
FIG. 8 shows a vertical section of the embodiment shown in FIG. 7 taken along the line 'CC'.

FIGS. 7 and 8 show a further embodiment where an annular series of perforations 55 are cut through into the cavity of the vessel 21 through the lapped section of the cemented or threaded lap joint 36. The perforations 55 are long relative to the strips 54 between the perforations 55 and provide a circumferential weakness in the vessel 21. The perforations 55 are designed so that the strips 54 fail when subjected to a predetermined tensile force thus releasing the pistons 22 and 23. For safe handling and storing of the pressure vessel 21 in this embodiment adhesive tape (not shown) is placed over the join 24 between the open ends of the pistons 22 and 23 so that the propellant 34 is not exposed. This tape is removed before the vessel 21 is loaded into the launch tube of the projectile launch system.

Figure 9A:
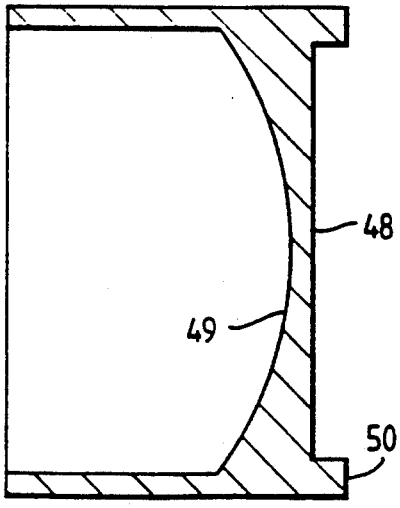
FIGS. 9A and 9B are sectional views of the closed end of the hollow cylindrical pistons showing alternative embodiments of t propulsion unit according to the present invention.
Figure 9B:
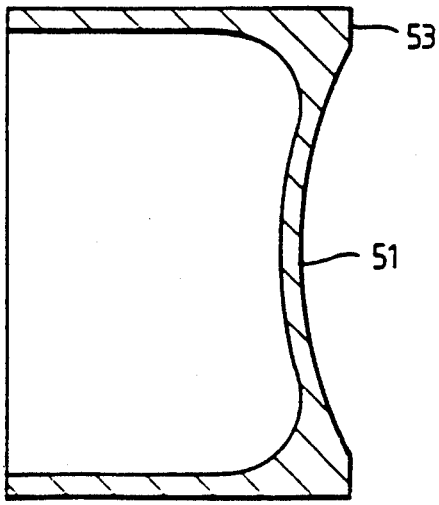

FIGS. 9A and 9B show two alternative embodiments to the one already shown in FIGS. 2 to 5 for the closed ends of the pistons 22 and 23. The preferred shape of the closed end of the pistons is determined by the shape of the projectile 60 of coutermass 61 resting thereon (see FIG. 10) and the shape and action of the piston intercepts 58 and 59.

FIG. 9A shows the closed end of the hollow cylindrical piston 22 or 23 having a plane outer surface 48 with a raised rim 50 and a domed inner surface 49 and FIG. 9B shows the closed end having a central concave dome 51 and an outer plane rim 53.

Figure 10:
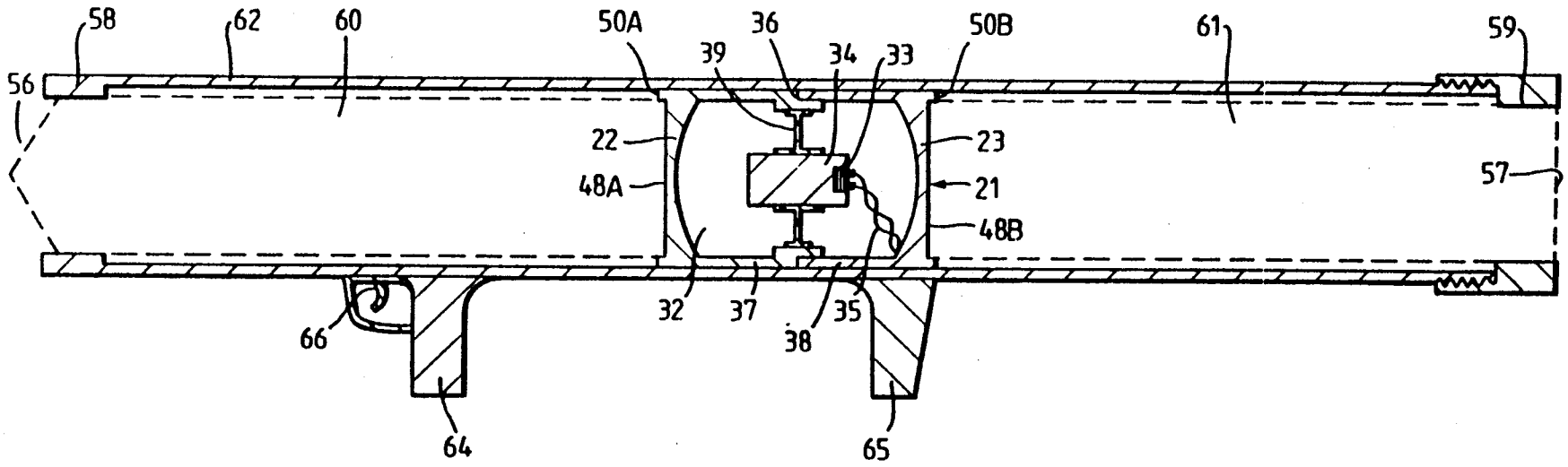
FIG. 10 is a schematic diagram showing a vertical longitudinal section of a recoilless mass/countermass projectile launcher loaded with a projectile and a countermass according to the present invention.

FIG. 10 shows a recoilless mass/countermass projectile launcher according to the present invention, which comprises a launch tube 62 which is open at its forward end 56 and rearward end 57. Piston intercepts 58 and 59 are located at the open ends of the tube 56 and 57 respectively. A propulsion unit 21 is located slideably within the launch tube 62, at the mid-point of the tube. The propulsion unit comprises two hollow cylindrical pistons 22 and 23 the open ends of which are releasably joined at 36 by a cemented lap joint as described previously in relation to FIGS. 2 to 5. Alternative embodiments of the releasable joint can be used as described previously in relation to FIGS. 6,7 and 8. The closed ends of the pistons 22 and 23 comprise plane central discs 48A and 48B and raised outer rims 50A and 50B respectively. The closed ends of the pistons 22 and 23 are designed to support the sub-calibre projectile 60 and sub-calibre countermass 61 respectively (shown in dotted lines). Said piston ends are also designed to provide a good contact with the piston intercepts 58 and 59 during braking. Alternative embodiments of the closed piston ends can be used and are described with reference to FIGS. 2 to 4 and 9B. The propellant charge 34 is located in the cavity 32 formed inside the closed pressure vessel 21 and is supported by a web 39. An igniter 33 is located on the surface of the propellant charge 34 and is connected to a triggering mechanism (not shown) by two wires 35 which pass through the two holes 30 bored in the raised outer rim 50B of piston 23. The sub-calibre projectile 60 and countermass 61 (shown in dotted lines) are supported prior to launch by the closed ends of the pistons 22 and 23 and piston intercepts 58 and 59 respectively. The piston intercept 58 is designed to halt the piston 22 and allow the projectile 60 to leave the forward end of the tube 56 unhindered. Likewise piston intercept 59 is designed to halt the piston 23 and allow the countermass 61 to leave the rearward end of the tube 57 unhindered. The launch tube 62 is supported by the human operator by two holding members 64 and 65. A trigger 66 is located on the holding member 64 and is connected to a triggering mechanism (not shown).

The recoilless mass/countermass projectile launcher and propulsion unit according the present invention operate as follows.

The trigger 66 is pressed activating the triggering mechanism (not shown) which in turn initiates the propellant charge 34 via the ignition wires 35 and igniter 33, producing a build up of hot propellant gases. When the hot propellant gases build up to a predetermined pressure, the tensile forces exerted on the releasable joint 36 cause it to fail, thus releasing the pistons 22 and 23. The piston 22 supporting the projectile 60 is projected along the launch tube 62 under the pressure of the propellant gases towards the open forward end 56. The piston 22 is halted by the piston intercept 58 and the projectile 60 is launched from the open forward end 56 of the launch tube unhindered. Simultaneously the piston 23 supporting the countermass 61 is projected along the launch tube 62 towards the open rearward end 57. The piston 23 is halted by the piston intercept 59 and the countermass 61 is launched from the open rearward end 57 of the launch tube unhindered.

The hollow cylindrical sections 37 and 38 of the pistons 22 and 23 respectively form piston skirts, which provide an effective gas seal with the launch tube 62. Therefore when the projectile 60 and countermass 61 have been launched from the tube 62 the halted pistons 22 and 23 seal its open ends, thus preventing an outrush of combustion gases therefrom.

I claim:

1. A double piston propulsion unit for a recoilless mass/countermass projectile launch system comprising:
   - two pistons of substantially equal mass arranged in a back-to-back relationship;
   - a propellant charge disposed between the two pistons, wherein each piston comprises a hollow cylinder with a closed outer end and an open inner end; and
   - a circumferential rupturable connecting means for joining together said open inner ends of the pistons such that the pistons together form a vessel enclosing said propellant charge, the hollow cylinder of each piston comprising a piston skirt.

2. A double piston propulsion unit according to claim 1 wherein the circumferential rupturable connecting means comprises a seal so that the pistons together form a closed pressure vessel.

3. A double piston propulsion unit according to claim 1 wherein said circumferential rupturable connecting means comprises an annular region of the vessel including a multiplicity of perforations therein.

4. A double piston propulsion unit according to claim 1 wherein the propellant charge is supported within the vessel by a support means extending radially inwards from the walls of the vessel.

5. A double piston propulsion unit according to claim 1 wherein each of said closed ends of the hollow cylinders comprises a central convex dome surrounded by a plane rim.

6. A double piston propulsion unit according to claim 1 wherein the circumferential rupturable connecting means comprises a lap joint with the lapped section of the joint located on the internal surface of the pressure vessel.

7. A double piston propulsion unit according to claim 6 wherein said lap joint is secured by a cement means for failing when subjected to a predetermined shear force.

8. A double piston propulsion unit according to claim 1 wherein said circumferential rupturable connecting means comprises a connecting collar which is located within the hollow cylinders and is secured over the circumferential region of contact between said open ends of the cylinders.

9. A double piston propulsion unit according to claim 8 wherein said connecting collar is made of a weaker material than that of the pressure vessel and has a circumferential rupturable weakness in the form of an annular groove in at least one of an inner and outer circumferential surface adjacent to the circumferential region of contact between said open ends of the cylinders.

10. A recoilless mass/countermass projectile launcher comprising:
   - a launch tube open at its forward and rearward ends;
   - a double piston propulsion unit comprising:
     - two pistons of substantially equal mass arranged in a back-to-back relationship;
     - a propellant charge disposed between the two pistons, wherein each piston comprises a hollow cylinder with a closed outer end and an open inner end; and
     - a circumferential rupturable connecting means for joining together said open inner ends of the pistons such that the pistons together form a vessel enclosing said propellant charge, the hollow cylinder of each piston comprising a piston skirt, the propulsion unit being slideably located inside the launch tube at its mid point; piston intercepts located at said forward and rearward ends of the launch tube, and a triggering means for activating the propulsion unit.

* * * * *